US009999840B1

(12) United States Patent
Clough

(10) Patent No.: US 9,999,840 B1
(45) Date of Patent: Jun. 19, 2018

(54) TABLE-TOP FORT

(71) Applicant: Mini-Kix, Inc., Brainerd, MN (US)

(72) Inventor: Jerad Clough, Baxter, MN (US)

(73) Assignee: Mini-Kix, Inc., Brainerd, MN (US)

( * ) Notice: Subject to any disclaimer, the term of this patent is extended or adjusted under 35 U.S.C. 154(b) by 110 days.

(21) Appl. No.: 15/165,319

(22) Filed: May 26, 2016

Related U.S. Application Data

(60) Provisional application No. 62/183,286, filed on Jun. 23, 2015.

(51) Int. Cl.
*A63G 33/00* (2006.01)
*A47G 11/00* (2006.01)
*A63H 33/00* (2006.01)

(52) U.S. Cl.
CPC ..... *A63H 33/008* (2013.01); *A47G 11/003* (2013.01); *A47G 11/006* (2013.01)

(58) Field of Classification Search
CPC ..... A47G 11/003; A47G 11/006; A47G 2011/005; A63H 33/008
USPC ..... 446/478
See application file for complete search history.

(56) References Cited

U.S. PATENT DOCUMENTS 1,332,776 A * 3/1920 Sultanaki ..... A47G 11/006 108/90
D178,193 S * 7/1956 Lindsay ..... D21/836
4,078,492 A * 3/1978 Levy ..... B41M 1/30 101/211
5,069,623 A * 12/1991 Peat ..... G09B 1/06 434/260
5,287,614 A * 2/1994 Ehrlich ..... A47G 11/006 150/158
D413,038 S * 8/1999 Trimarchi ..... D6/610
6,574,896 B1 * 6/2003 Howell ..... A47G 1/0616 40/737
7,640,698 B2 * 1/2010 Graham ..... B60J 11/00 150/166
D666,267 S * 8/2012 Caul ..... D21/837
D737,919 S * 9/2015 Wienke ..... D21/836
(Continued)

FOREIGN PATENT DOCUMENTS

GB 725274 A * 3/1955 ..... A63H 33/008

*Primary Examiner* — Robert Canfield
(74) *Attorney, Agent, or Firm* — Moss & Barnett; Michael A. Bondi

(57) ABSTRACT

A table-top fort for use in conjunction with a table having a top surface that is supported above a ground surface. The table-top fort includes a top panel and a side panel. The top panel has an edge that extends substantially around the top panel. The top panel has a size and a shape that are substantially the same size and a shape of the top surface. The side panel engages the top panel and extends at least partially around the edge. The side panel has a lower edge, at least one opening formed therein and at least one partially transparent region formed therein. The opening is movable between an open configuration and a closed configuration. The table-top fort is placed over the table so that the top panel is above the top surface to form a substantially enclosed region beneath the table. The side panel other than the at least one partially transparent region is substantially non-transparent that is printed on the side panel. The non-transparent and at least partially transparent areas of the side panel are fabricated from the same material.

18 Claims, 2 Drawing Sheets

(56) References Cited

U.S. PATENT DOCUMENTS

| | | | | |
|---|---|---|---|---|
| 2002/0088564 | A1* | 7/2002 | Zheng | A63B 9/00 160/354 |
| 2005/0106990 | A1* | 5/2005 | Field | A63H 33/008 446/220 |
| 2007/0204944 | A1* | 9/2007 | Diaz | A47G 11/003 150/158 |
| 2009/0093182 | A1* | 4/2009 | Jacobs | A63H 33/008 446/120 |
| 2009/0100736 | A1* | 4/2009 | Bunce | A01M 31/025 43/1 |
| 2014/0127966 | A1* | 5/2014 | Williamson | A63H 33/008 446/478 |
| 2016/0215558 | A1* | 7/2016 | Byun | E06B 9/262 |

* cited by examiner

TABLE-TOP FORT

REFERENCE TO RELATED APPLICATION

This application claims priority to Provisional Applic. No. 62/183,286, filed on Jun. 23, 2016, the contents of which are incorporated herein by reference.

FIELD OF THE INVENTION

The invention relates generally to a play toy for children. More particularly, the invention relates to a table-top fort that is placed over a table.

BACKGROUND OF THE INVENTION

Even though children are increasingly playing with electronic toys, there is significant development that can be gained when children play with non-electronic toys. In particular, the non-electronic toys encourage the children to develop their creativity.

One such type of non-electronic toy involves creating a fort using tables and/or chairs. One part of the creativity relates to making the fort from objects around the house such as by positioning chairs with respect to the table to at least partially enclose the area beneath the table. Another part of the creativity relates to playing in or around the fort that has been built by the children.

SUMMARY OF THE INVENTION

An embodiment of the invention is directed to a play fort that includes a table and a table-top fort. The table has a top surface and at least one leg that engages the top surface for supporting the top surface a distance above a ground or floor surface. The table-top fort includes a top panel and a side panel. The top panel has an edge that extends substantially around the top panel. The top panel has a size and a shape that are substantially the same size and a shape of the top surface. The side panel engages the top panel and extends at least partially around the edge. The side panel has a lower edge, at least one opening formed therein and at least one partially transparent region formed therein. The opening is movable between an open configuration and a closed configuration. The table-top fort is placed over the table so that the top panel is above the top surface and the lower edge of the side panel is proximate the ground or floor surface to form a substantially enclosed region beneath the table.

Another embodiment of the invention is directed to a table-top fort for use in conjunction with a table having a top surface that is supported above a ground surface. The table-top fort includes a top panel and a side panel. The top panel has an edge that extends substantially around the top panel. The top panel has a size and a shape that are substantially the same size and a shape of the top surface. The side panel engages the top panel and extends at least partially around the edge. The side panel has a lower edge, at least one opening formed therein and at least one partially transparent region formed therein. The opening is movable between an open configuration and a closed configuration. The table-top fort is placed over the table so that the top panel is above the top surface to form a substantially enclosed region beneath the table. The side panel other than the at least one partially transparent region is substantially non-transparent that is printed on the side panel. The non-transparent and at least partially transparent areas of the side panel are fabricated from the same material.

Another embodiment of the invention is directed to a method of fabricating a play fort. A table is provided that includes a top surface and at least one leg that engages the top surface for supporting the top surface a distance above a ground or floor surface. A side panel is formed with at least one partially transparent region by printing on the side panel. The side panel other than the at least one partially transparent region is substantially non-transparent. The non-transparent and at least partially transparent areas of the side panel are fabricated from the same material. The side panel is attached to an edge that extends substantially around a top panel to form the table-top fort. The top panel has a size and a shape that are substantially the same size and a shape of the top surface. At least one opening is formed in the side panel. The opening is movable between an open configuration and a closed configuration. The table-top fort is placed over the table so that the top panel is above the top surface and a lower edge of the side panel is proximate the ground or floor surface to form a substantially enclosed region beneath the table.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 1:
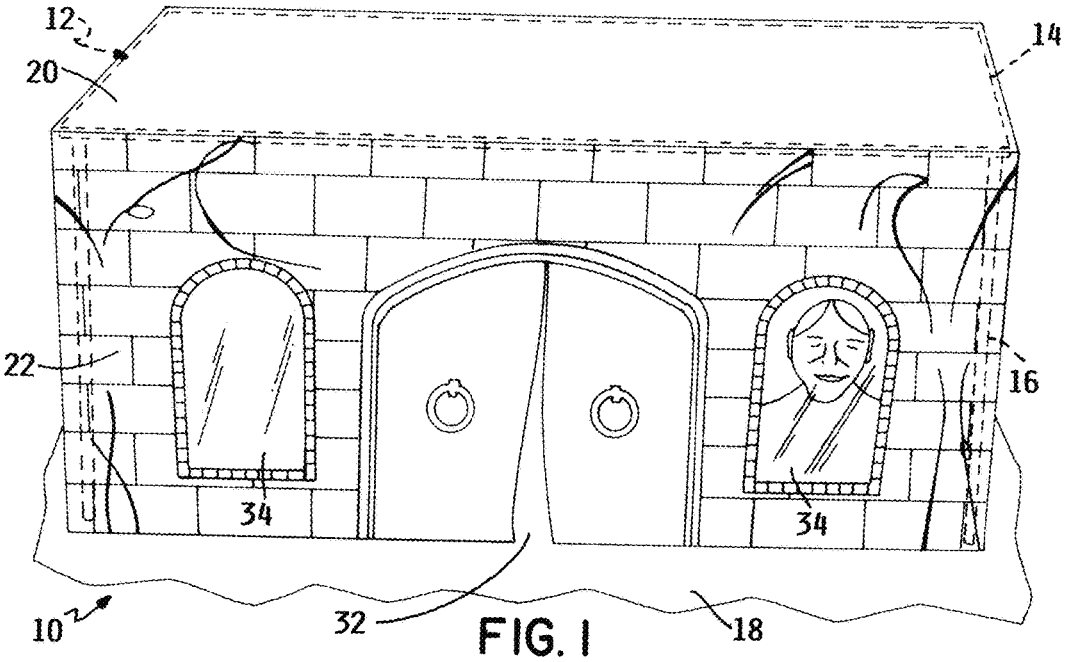
FIG. 1 is a front view of a table-top fort according to an embodiment of the invention.
Figure 2:
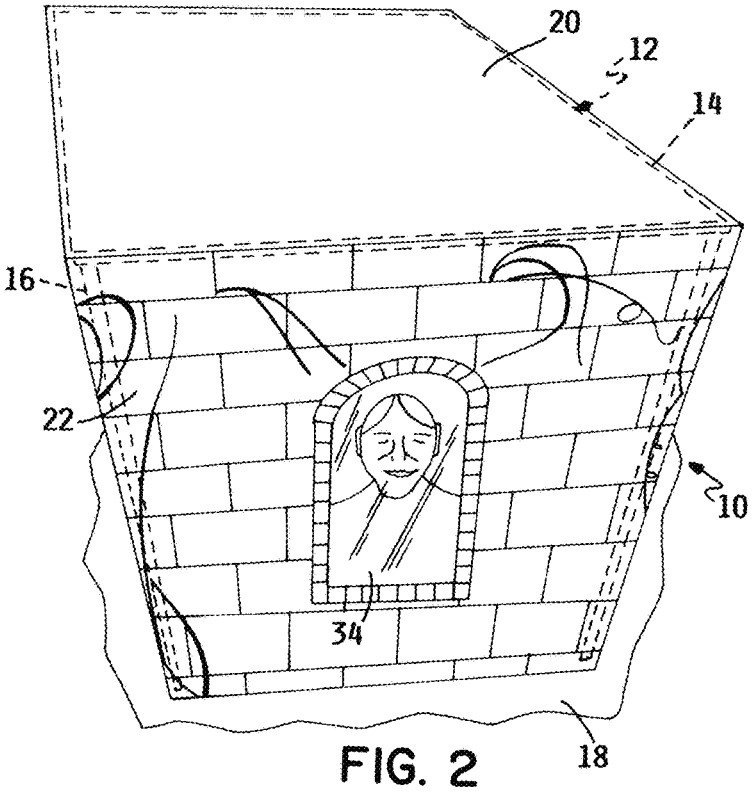
FIG. 2 is a side view of the table-top fort of FIG. 1.
Figure 3:
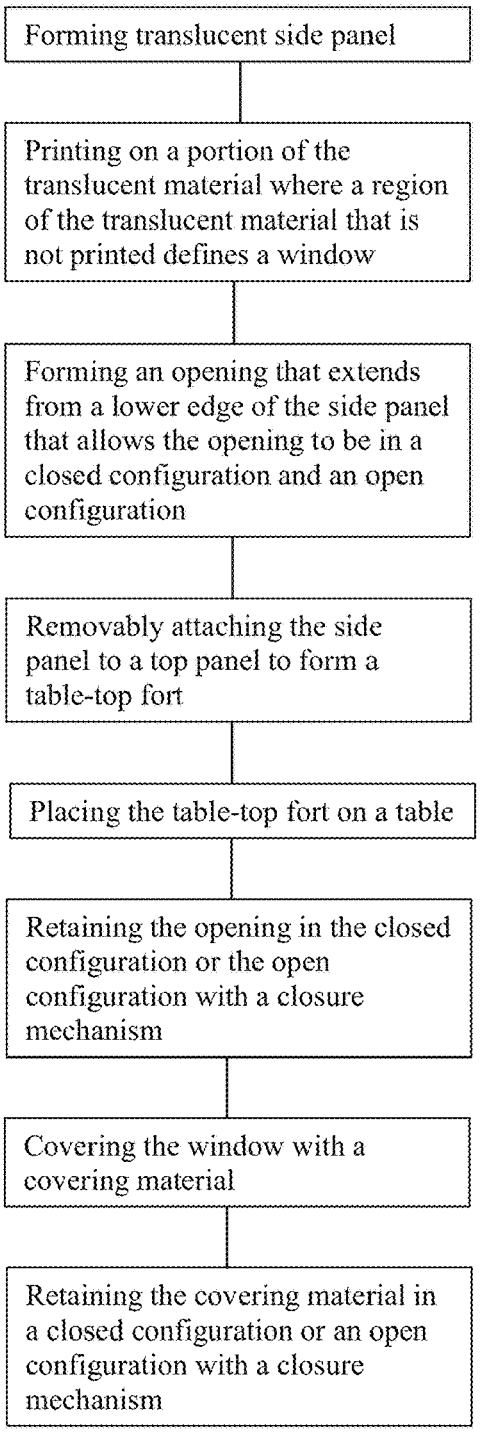
FIG. 3 is a flow diagram illustrating fabrication of the table-top fort.

An embodiment of the invention is directed to a table-top fort, which is illustrated at 10 in FIGS. 1 and 2. Fabrication of the table-top fort 10 is illustrated in FIG. 3 and described herein. The table-top fort 10 is desired for use in conjunction with a table 12 to at least partially enclose a region under the table 12. The table-top fort 10 thereby converts the table 12 into a fort in which children can play.

The table 12 includes a top surface 14 and at least one leg 16 that supports the top surface 14 above a ground or floor surface 18. The top surface 14 may have a variety of configurations. In one such embodiment, the top surface 14 is generally rectangular. In other embodiments, the top surface 14 may be square, circular or oval. The top surface 14 may have a width and a length that are both between about 2 feet and about 8 feet depending on the number of people that are expected to sit around the table 12.

The at least one leg 16 may be rigidly attached to the top surface 14. In other embodiments, the at least one leg 16 may be pivotally attached to the top surface 14 for movement between an extended use configuration and a folded storage configuration.

In certain embodiments, the top surface 14 may be at a height above the ground or floor surface 18 of between about 24 inches and about 36 inches so that the table 12 may be used in conjunction with conventional chairs. In other embodiments, the top surface 14 is approximately 30 inches above when ground or floor surface 18 when the table 12 is in the use configuration.

The table-top fort 10 may generally include a top panel 20 to which a side panel 22 is attached. The top panel 20 may be fabricated with a length, width and shape that are similar to a length, width and shape of the table on which it is intended to use the table-top fort 10.

The side panel 22 may be fabricated to extend at least partially around the top panel 20. In certain embodiments, the side panel 22 extends substantially around the top panel 20. When the table has a generally rectangular configuration, the side panel 22 thereby includes two end sections 26 and two side sections 28 where the side sections 28 are positioned intermediate the end section 26. The end sections 26 may have a width that is less than the width of the side sections 28.

The side panel 22 may be fabricated with a height that is similar to a height of the table 12 on which the table-top fort 10 is intended to be uses. Using such a configuration causes a lower edge of the side panel 22 to be proximate the ground or floor surface that is beneath the table 12. This configuration thereby causes the table-top fort 10 to define a substantially enclosed region beneath the table 12.

The side panel 22 may include at least one opening 32 in the side panel 22 to facilitate the child moving into and out of the substantially enclosed region. While FIG. 1 illustrates that the opening 32 is positioned in the side section 28, a person of skill in the art will appreciate that the at least one opening 32 may be positioned in a variety of locations on the side panel 22.

In one such configuration, the at least one opening 32 comprises a generally vertically oriented separation that enables the child to pass through the side panel 22. The opening 32 extends at least partially from a lower edge of the side panel 22 to an upper edge of the side panel 22. A person of skill in the art will appreciate that the at least one opening 32 may be defined using a variety of techniques.

To enhance the ability of the table-top fort 10 to create the substantially enclosed region, the side panel 22 may facilitate substantially closing the opening 32 when the child is not passing therethrough.

The table-top fort 10 may include a closure mechanism to hold the opening 32 in a closed configuration so as to restrict the ability of children to move into or out of the substantially enclosed region. An example of one such closure mechanism that may be used to hold the opening 32 in the closed configuration is a hook and loop fastener such as is available under the designation VELCRO.

While not illustrated, the table-top fort 10 may also include a closure mechanism to hold the opening 32 in an open configuration. An example of one such closure mechanism that may be used to hold the opening 32 in the open configuration is a hook and loop fastener such as is available under the designation VELCRO.

The side panel 22 may include at least one at least partially transparent region 34. The at least partially transparent region 34 may be similar to a window. In certain embodiments, the at least partially transparent region 34 is fabricated from the same material that is used to fabricate the other portions of the side panel 22. In other embodiments, the at least partially transparent region 34 may be fabricated from a material that provides enhanced transparency compared to the material that is used to fabricate the other portions of the side panel 22.

While not illustrated, a covering material may be provided proximate the at least partially transparent region 34. The covering material may enable the at least partially transparent region 34 to be substantially covered to thereby prevent viewing through the at least partially transparent region 34.

The covering material may be attached to either an inwardly directed surface or an outwardly directed surface of the side panel 22. An advantage of attaching the covering material to the inwardly directed surface is that children inside of the table-top fort 10 have the ability to control whether the covering material is opened or closed.

A closure mechanism may be provided to maintain the covering material in a raised or lowered configuration. An example of one such closure mechanism that may be used to hold the covering material in the raised or lowered configuration is a hook and loop fastener such as is available under the designation VELCRO.

To enhance the table-top fort 10, at least a portion of the side panel 22 and the top panel 20 may have a design thereon. For example, the design may replicate a medieval castle such as illustrated in the figures. In addition to printing the design on one surface of the side panel 22 and/or the top panel 20, two different designs may be printed on opposite surfaces of the side panel 22 and/or the top panel 20. With such a configuration, the theme of the creative play may be changed by inverting the table-top fort 10 to thereby increase the time with which the children play with the table-top fort 10.

The different designs can relate to an interior or an exterior of a building such as a castle. Alternatively, the different designs can relate to different themes. For example, one design can be medieval and another design can relate to sports.

In certain embodiments, the design is printed on the side panel 22. A variety of techniques may be used to print the design. An example of one such suitable technique is dye sublimation printing.

An advantage of using dye sublimation printing is that the design can be customized in a cost-effective manner. For example, the design can incorporate the name or names of the children who will be using the table-top fort 10. The design can also incorporate items that are of particular interest to a particular child.

When the side panel 22 is fabricated from a translucent material, it is possible for the windows (partially transparent regions) 34 to be formed by not printing in certain areas of the side panel 22. The areas in which the printing is provided become substantially non-transparent. A significant benefit of this process is that the side panel 22 can be fabricated without the additional time and expense associated with sewing or otherwise attaching the partially transparent regions 34 to the side panel 22.

While it is illustrated that no design is provided on the top panel 20, it is possible to form a variety of designs thereon. For example, the designs could be associated with eating a meal such as plates, cups and flatware. Alternatively or additionally, the design could relate to alternate activities such as relating to board games such as are used in conjunction with playing chess or checkers.

Because it is desired for the table-top fort 10 to create the substantially enclosed region where the lower edges of the side panels 22 are proximate the surface on which the table 12 is placed, the table-top fort 10 may be fabricated based upon the particular table 12.

The table-top fort 10 may be designed for use with a table 12 having a particular length, width or shape. In certain embodiments, the table-top fort 10 may be designed for use with a rectangular table having a width of about 30 inches and lengths of either 4 feet, 5 feet or 6 feet. Alternatively, the table-top fort 10 may be shaped for use with an oval table 12.

As an alternative to fabricating the table-top fort 10 for use with a table 12 having a particular length, width or shape, it is possible for the table-top fort 10 to be customizable such that it can be used with tables 12 having a variety of lengths, widths and shapes. In such an embodiment, a portion of the side panel 22 may be cut off if the side panel 22 is too long for use in conjunction with a particular table 12.

Alternatively, the side panel 22 may be fabricated separate from the top panel 20 and then attached to the top panel 20 based upon the shape of the table 12. An example of one such mechanism that facilitates removable attachment of the side panel 22 to the top panel 20 is a hook and loop fastener.

In yet another embodiment, the table top fort 10 includes the side panel 22 and a plurality of clips (not shown) that are used to attach the side panel 22 to the table 12. For example, a hook and loop fastener such as is available under the designation VELCRO may be used to attach the side panel 22 to the plurality of clips.

In operation, the table-top fort 10 is selected based upon the size and shape of the table 12 on which the table-top fort 10 is intended to be used. The design for the table-top fort 10 is selected based upon the child or children who are intended to use the table-top fort 10. The selected design may include the name, image and/or favorite items of the child or children who are intended to use the table-top fort 10.

The table-top fort 10 is placed over the table 12 to define the substantially enclosed region. In certain embodiments, the lower edge of the side panel 22 is proximate the surface 18 on which the table stands.

Thereafter, the child or children move into and out of the substantially enclosed region such as using the opening 32. The design on the table-top fort 10 may provide inspiration to the child or children to inspire creativity associated with their play.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A play fort comprising:

a table comprising a top surface and at least one leg that engages the top surface for supporting the top surface a distance above a ground or floor surface; and a table-top fort comprising:

a top panel having an edge that extends substantially around the top panel; and a side panel extends at least partially around the edge, wherein the side panel is fabricated from a translucent material, wherein a portion of the translucent material is printed, wherein a region of the translucent material that is not printed defines a window, wherein the printed region is less transparent than the non-printed region and wherein the table-top fort is placed over the table to form a substantially enclosed region beneath the table.

2. The play fort of claim 1, wherein the top surface has a rectangular shape and the side panel comprises two end section and two side sections and wherein the end sections are between the side sections.

3. The play fort of claim 1, wherein the side panel is removably attached to the top panel.

4. The play fort of claim 1, wherein the side panel extends substantially around the edge.

5. The play fort of claim 1, wherein the side panel comprises an opening formed therein, wherein the opening extends from a lower edge of the side panel, wherein the side panel is movable to place the opening in a closed configuration and an open configuration and wherein the table-top fort further comprises a closure mechanism to retain the opening in at least one of the closed configuration and the open configuration.

6. The play fort of claim 1, wherein the table-top fort further comprises:

a covering material for selectively covering the window; and a closure mechanism for maintaining the covering material in at least one of an open configuration and a closed configuration with respect to the window.

7. A table-top fort for use in conjunction with a table having a top surface that is supported above a ground surface, wherein the table-top fort comprises:

a top panel having an edge that extends substantially around the top panel; and a side panel that engages the top panel and extends at least partially around the edge, wherein the side panel is fabricated from a translucent material, wherein a portion of the translucent material is printed, wherein a region of the translucent material that is not printed defines a window, wherein the printed portion is less transparent than the non-printed region and wherein the side panel comprises:

at least one opening formed therein, wherein the opening is movable between an open configuration and a closed configuration;

wherein the table-top fort is placed over the table to form a substantially enclosed region beneath the table.

8. The table-top fort of claim 7, wherein the side panel is removably attached to the top panel.

9. The table-top fort of claim 7, wherein the side panel extends substantially around the edge.

10. The table-top fort of claim 7, wherein the opening extends from lower edge of the side panel, wherein the side panel is movable to place the opening in a closed configuration and an open configuration and wherein the table-top fort further comprises a closure mechanism to retain the opening in at least one of the closed configuration and the open configuration.

11. The table-top fort of claim 7, wherein the table-top fort further comprises:

a covering material for selectively covering the window; and a closure mechanism for maintaining the covering material in at least one of an open configuration and a closed configuration with respect to the window.

12. A method of fabricating a play fort comprising:

providing a table comprising a top surface and at least one leg that engages the top surface for supporting the top surface a distance above a ground or floor surface;

fabricating a side panel from a translucent material;

printing on a portion of the translucent material, wherein a region of the translucent material that is not printed defines a window and wherein the printed portion is less transparent than the non-printed region;

attaching the side panel to an edge that extends substantially around a top panel to form a table-top fort, wherein the top panel has a size and a shape that are substantially the same size and a shape of the top surface;

forming an opening in the side panel, wherein the opening is movable between an open configuration and a closed configuration; and placing the table-top fort over the table so that the top panel is above the top surface to form a substantially enclosed region beneath the table.

13. The method of claim 12, and further comprising forming the top surface with a rectangular shape, wherein the side panel comprises two end sections and two side sections and wherein the end sections are between the side sections.

14. The method of claim 12, wherein the attaching the side panel comprises removably attaching the side panel.

15. The method of claim 12, and further comprising:

forming the opening to extend from the lower edge, wherein the side panel is movable to place the opening in a closed configuration and an open configuration; and retaining the opening in at least one of the closed configuration and the open configuration with an opening closure mechanism.

16. The method of claim 12, and further comprising:

selectively covering the window with a covering material; and maintaining the covering material in at least one of an open configuration and a closed configuration with respect to the window using a closure mechanism.

17. A method of fabricating a play fort comprising:

providing a table comprising a top surface and at least one leg that engages the top surface for supporting the top surface a distance above a ground or floor surface;

fabricating a table-top fort from a translucent material, wherein the table top fort comprises a top panel and a side panel;

printing on a portion of the translucent material, wherein a region of the translucent material that is not printed defines a window and wherein the printed portion is less transparent than the non-printed region;

forming an opening in the side panel, wherein the opening is movable between an open configuration and a closed configuration; and placing the table-top fort over the table so that the top panel is above the top surface to form a substantially enclosed region beneath the table.

18. The method of claim 17, and further comprising:

forming the side panel separate from the top panel; and attaching the side panel to the top panel.

* * * * *